US009004647B2

(12) United States Patent
Hudd et al.

(10) Patent No.: US 9,004,647 B2
(45) **Date of Patent: *Apr. 14, 2015**

(54) PRINT CARRIAGE

(75) Inventors: Alan Hudd, Cambridgeshire (GB); Gerrit Koele, Diepenheim (NL); Simon Bennet, Auckland (NZ)

(73) Assignee: Xennia Holland B.V., Almelo (NL)

( * ) Notice: Subject to any disclaimer, the term of this patent is extended or adjusted under 35 U.S.C. 154(b) by 378 days.

This patent is subject to a terminal disclaimer.

(21) Appl. No.: 13/285,097

(22) Filed: Oct. 31, 2011

(65) Prior Publication Data

US 2012/0281043 A1 Nov. 8, 2012

Related U.S. Application Data

(63) Continuation of application No. PCT/EP2010/055769, filed on Apr. 28, 2010.

(30) Foreign Application Priority Data

Apr. 29, 2009 (GB) ..... 0907362.8

(51) Int. Cl.
*B41J 2/165* (2006.01)
*B41J 2/21* (2006.01)
*B41J 19/16* (2006.01)

(52) U.S. Cl.
CPC *B41J 2/2132* (2013.01); *B41J 2/21* (2013.01); *B41J 19/16* (2013.01)

(58) Field of Classification Search
None
See application file for complete search history.

(56) References Cited

U.S. PATENT DOCUMENTS

| | | | | |
|---|---|---|---|---|
| 4,864,328 | A | 9/1989 | Fischbeck | |
| 4,907,013 | A | 3/1990 | Hubbard et al. | |
| 4,963,882 | A | 10/1990 | Hickman | |
| 5,581,284 | A | 12/1996 | Hermanson | |
| 5,587,730 | A | 12/1996 | Karz | |
| 5,640,183 | A | 6/1997 | Hackleman | |
| 5,838,343 | A | 11/1998 | Chapin et al. | |
| 6,076,983 | A | 6/2000 | Stein et al. | |
| 6,095,637 | A | 8/2000 | Hirabayashi et al. | |
| 6,139,128 | A | 10/2000 | Magirl et al. | |
| 6,164,745 | A * | 12/2000 | Nagoshi et al. | 347/15 |
| 6,267,518 | B1 * | 7/2001 | Abe | 400/188 |
| 6,322,197 | B1 | 11/2001 | Yanaka | |
| 6,439,786 | B1 | 8/2002 | Hasiuk | |

(Continued)

FOREIGN PATENT DOCUMENTS

| | | | |
|---|---|---|---|
| EP | 0829368 | A2 | 3/1998 |
| EP | 0992353 | A1 | 4/2000 |

(Continued)

*Primary Examiner* — Alejandro Valencia
(74) *Attorney, Agent, or Firm* — Hoyng Monegier LLP; Minerva Rivero; David P. Owen

(57) ABSTRACT

A system and method for depositing a substance onto a continuously moving substrate in first and second transverse swathes, is achieved by providing a print carriage having a first set of inkjet heads and a second set of inkjet heads. The carriage is traversed across the substrate in a forward pass, while depositing the first and second swathes from the respective first and second plurality of inkjet heads and subsequently traversed across the substrate in a reverse pass. The first and second sets of inkjet heads are arranged such that the first and second swathes complement one another on both forward and reverse passes to provide substantially complete coverage of the substrate. In this manner complementary swathes may be deposited from a single head.

20 Claims, 7 Drawing Sheets

(56) References Cited

U.S. PATENT DOCUMENTS

| | | | | |
|---|---|---|---|---|
| 8,557,340 | B2 * | 10/2013 | Koele et al. | 427/265 |
| 2006/0292291 | A1 | 12/2006 | White et al. | |
| 2010/0279081 | A1 * | 11/2010 | Koele et al. | 428/195.1 |

FOREIGN PATENT DOCUMENTS

| | | | |
|---|---|---|---|
| EP | 1573109 | B1 | 11/2006 |
| JP | 10-315541 | A | 12/1982 |
| JP | 6-171110 | A | 6/1994 |
| JP | 8-127138 | A | 5/1996 |
| JP | 9-39220 | A | 2/1997 |
| JP | 10-44518 | A | 2/1998 |
| JP | 11-58877 | A | 3/1999 |
| JP | 2000-135784 | A | 5/2000 |
| JP | 2000-135830 | A | 5/2000 |
| JP | 2001-88314 | A | 4/2001 |
| JP | 2002-166531 | A | 6/2002 |
| JP | 2002-361940 | A | 12/2002 |
| JP | 2006-205004 | A | 8/2006 |
| JP | 2008-534792 | A | 8/2008 |
| JP | 2008-132795 | A | 12/2008 |
| WO | 2006060644 | A2 | 6/2006 |
| WO | 2006100273 | A1 | 9/2006 |
| WO | 2006100275 | A1 | 9/2006 |

* cited by examiner

PRINT CARRIAGE

CROSS-REFERENCE TO RELATED APPLICATIONS

This application is a continuation of PCT patent application number PCT/EP2010/055769 filed on 28 Apr. 2010, which claims priority from United Kingdom patent application number GB 0907362.8 filed on 29 Apr. 2009. Both applications are hereby incorporated by reference in their entireties.

BACKGROUND OF THE INVENTION

1. Field of the Invention

The invention relates generally to a print carriage for the deposition of a substance onto a substrate using printing techniques and the like. The invention further relates to a printer provided with such a print carriage and to procedures for performing deposition in a continuous process, in particular in the fields of textile printing and finishing.

2. Description of the Related Art

Systems for inkjet printing of images and text onto a substrate are generally known. Many such systems are adapted to desktop or office application and are well suited for performing printing onto A3 or A4 sized paper or the like. For wider substrates, more specialized machinery is required, in particular when high speed is important. For such applications, inkjet printing techniques may be used but lithographic and conventional printing techniques are still generally favoured.

For textiles, inkjet printing techniques have also recently been developed as an alternative to traditional printing, dyeing and coating techniques. These techniques are generally distinct from those used in the graphics field, due to material and dyestuff considerations. Attempts have also been made to adapt inkjet deposition techniques for textile upgrading and finishing procedures. A characteristic of these processes is often that they require considerable volumes of product to be deposited across the whole textile surface. In many situations, the uniformity of the deposition or coating is of paramount importance as the quality of the fabric depends upon it. This uniformity may be important from a visual perspective (absence of streaks or blemishes) and also from a functional perspective (waterproofing or flame retardancy).

There are currently two main system configurations used for inkjet printing: fixed array systems and scan and step arrangements. Both are mainly used with drop on demand (DoD) techniques but may also be used with continuous inkjet (CIJ) techniques.

Fixed array systems allow printing of a continuously moving substrate at relatively high production speeds. A fixed array of print heads is arranged across the width of the substrate and the nozzles are activated to deposit material as required onto the substrate which is in continuous motion below the print head array. Typically fixed array systems are used for narrow width substrates on continuous reel to reel web systems, as only a few print heads are required to cover the width of the substrate. The use of fixed array inkjet procedures for textile finishing is described in European Patent EP-B-1573109.

Fixed array systems have a number of drawbacks, mainly related to the low flexibility and lack of redundancy in such a printing system. When printing onto a wide substrate with a fixed array system, a large number of print heads are required to straddle the width of the substrate, leading to a high capital cost for the printing system. If the required substrate speed is below the maximum speed of the print head (e.g. due to other slower processes), then this extra system capacity cannot be usefully exploited and is wasted i.e. at anything below maximum speed, the printing system is making inefficient use of the print heads present. The resolution across the substrate width is fixed by the position of the print head nozzles and cannot therefore be readily varied. When maintenance of a print head is required, the substrate must stop and the array must be moved away from the substrate to allow access to the print heads. This is often a relatively complex operation and the downtime associated therewith can be costly. In the event that a nozzle fails during printing, a single vertical line appears on the substrate, which is a particularly visible mode of failure and represents a complete 100% failure to deposit material in the localized area. Printing a continuous image also requires a complex continuous data handling system. The system must continuously feed data to the print head nozzles, to maintain the image continuously printing on the substrate and there is no obvious break point (or time) where memory can be reloaded. This means that many fixed array printing systems have a repeat length dependant on their memory capacity, after which the image is simply repeated. This situation can be avoided by using dynamic memory handling where data is fed into memory as fast as it is fed out to the print heads but this requires a significantly more complicated memory management system.

Scan and step arrangements operate to scan a print head carriage across the width of a stationary substrate to print a horizontal band or swathe. The substrate is then precisely incremented forwards, before the print head carriage makes another pass across the stationary substrate to print a second swathe. Such systems are typically used for printing onto wide substrates of up to 5 m where a fixed array would be impractical. They are also used in applications where lower productivity is acceptable i.e. wide format commercial graphic arts printing.

Scan and step systems also have a number of drawbacks, mainly focused on the low productivity and the stepping nature of the substrate motion. In particular, the stepping of the substrate means that such a system has poor compatibility when used as a component or process within a continuous production line. The time taken to increment or step the substrate cannot be used for printing and limits productivity. The stepping motion also means that the substrate must be rapidly accelerated and decelerated, which requires powerful motors and a high level of control when dealing with wide substrates on heavy rollers. The stepping motion must also occur with high accuracy and repeatability, as this motion affects the down web resolution and thus the quantity of material deposited (for functional applications) or the image quality (for imaging applications). According to one device disclosed in EP-A-0829368, one or more printheads may be oriented to scan the width of a textile web at a bias angle. By printing diagonally, the printheads may operate for longer at their maximum traverse velocity. The loss of efficiency due to acceleration and deceleration of the printhead is thereby reduced although operation still takes place in scan and step mode.

All of these drawbacks have hitherto made continuous, high-speed and highly uniform deposition onto wide substrates difficult to achieve. In particular, the reliability of print heads for such operations is still far from optimal. A DoD nozzle requires continuous preventative maintenance in order to keep it functioning correctly, which is a key element in system design. If the nozzle is not used for a period it will block and not fire when subsequently required. For scan and step systems, the scanning motion of the print heads allows the turn around time at the end of each pass to be available for regular maintenance of the print heads. This may involve the cleaning of each jet or nozzle to prevent blockage and/or spitting of ink from idle nozzles. Nevertheless, the maintenance time comes at the expense of intermittent motion of the substrate. This can be a cause of additional indexing faults and wear in the drive train. Furthermore, the rapid acceleration of the print cartridge at each traverse is a potential source of mechanical failure and a design limitation.

In an array configuration, regular maintenance opportunities are not available. There have been many attempts in the inkjet industry to compensate for missing nozzles or malfunctioning nozzles. U.S. Pat. No. 4,907,013 discloses circuitry for detecting a malfunctioning nozzle in an array of nozzles in the inkjet print head. If the printer processor is unable to compensate for the malfunctioning nozzle by stepping the print head and using non-malfunctioning nozzles during subsequent passes over the print medium, the printer is shut down. U.S. Pat. No. 4,963,882 discloses using multiple nozzles per pixel location. In one embodiment, two ink droplets of the same colour are deposited upon a single pixel location from two different nozzles during two passes of the print head. U.S. Pat. No. 5,581,284 discloses a method for identifying any failed nozzle in a full width array print bar of a multicolour printer and substituting at least one droplet from a nozzle in another print bar having a different colour of ink. U.S. Pat. No. 5,640,183 discloses a number of droplet ejecting nozzles are added to the standard column of nozzles in a nozzle array, so that a number of redundant nozzles are added at the ends of each column of nozzles. The print head is shifted regularly or pseudo-randomly such that a different set of nozzles prints over the first printed swathe during a subsequent pass of the print head in a multi-pass printing system. U.S. Pat. No. 5,587,730 discloses a thermal inkjet printing apparatus having a redundant printing capability including a primary print head and a secondary print head. In one mode, if the primary print head fails, the secondary print head prints ink drops of the first colour in place of the primary print head.

A printing device is disclosed in U.S. Pat. No. 6,439,786 that attempts to synchronise motion of a web of paper with traverse of a print head in order to achieve continuous paper feed. The print head is mounted to traverse on a beam that can be angled in two directions with respect to the feed direction. On each traverse the print head moves with the paper to produce a resultant horizontal print band on the moving paper.

In a further device disclosed in Japanese Publication JP10-315541 a serial printer is described for enhancing print resolution in the paper transport direction. This is achieved by continuously transporting the paper whereby effects of backlash in the transport mechanism may be reduced. Printing onto the moving substrate results in diagonal swathes which may be aligned with each other in single or double pass movement. The device is directed to printing onto sheets of paper and is not concerned with enhancing printing speed on large format substrates. In particular, when printing on both the forward and reverse passes, the print head addresses only unprinted areas of the paper, leading to inefficient nozzle usage. Furthermore, the document fails to address the need for enhanced head length for printing wide swathes onto large format substrates.

A recent development is described in unpublished application WO2009/056641, the contents of which are hereby incorporated in their entirety, in which a substance is deposited onto a continuous supply of substrate by traversing a deposition arrangement across the substrate to deposit the substance in a number of swathes. The substrate may be carried by a transport arrangement in the form of a conveyor belt. By synchronising the transport and traverse motions, the swathes can be made to complement one another, thus achieving substantially complete coverage of the substrate. The principle combines advantages of both scan and step and fixed array systems to achieve reliable printing with continuous substrate motion.

According to one embodiment of the device disclosed in WO2009/056641, two complementary swathes of the substance are deposited by two carriages, each mounted for independent motion on a respective beam. Each carriage comprises a plurality of heads, thus achieving a wide swathe in the transport direction and more efficient coverage. While this arrangement has been found to operate in a satisfactory manner, the setting up thereof is difficult and variations in transport speed or other print parameters can require recalibration. Any motion of the substrate with respect to the transport belt between the first and second carriages can be catastrophic to the result. The same applies to irregularities in the motion of the transport belt. These and other difficulties become more significant as the substrate width and transport speed increase.

BRIEF SUMMARY OF THE INVENTION

The present invention seeks to address at least some of these difficulties by using a single print carriage to deposit both complementary swathes. Accordingly the print carriage comprises a first plurality of inkjet heads arranged to deposit a substance onto the substrate in forward and reverse passes of a first swathe; a second plurality of inkjet heads arranged to deposit the substance onto the substrate in forward and reverse passes of a second swathe, complementary to the first swathe; wherein the first and second plurality of heads are arranged to ensure that the first and second swathes complement one another on both forward and reverse passes. In this context, complementary may be understood to mean that uniform coverage is achieved by superposition of two swathes such that each portion of the substrate is covered either twice by one of the swathes or once by each swathe. It will be understood that any errors occurring due to failure of an individual nozzle will be significantly less visible as a result both of diagonal motion and due to the fact that each portion of the substrate will be addressed twice by different nozzles. By providing the first and second swathes from a single carriage, the offset between the heads that deposit the first and second swathes may be precisely determined and maintained. An alignment means or arrangement may be provided to ensure alignment within the carriage. No alignment and synchronisation between a pair of carriages is thus required, reducing significantly the calibration required at set-up and on changing of print parameters.

In order to achieve full coverage of a wide textile using a single carriage arrangement, the width of each swathe should preferably be as large as possible. This may be achieved by aligning the plurality of heads of each swathe, wherein each print head comprises a line of nozzles which are aligned with the nozzles of the other print heads. Preferably, the resulting carriage will have a length in the transport direction of at least 0.3 m, preferably 0.5 m and even as much as 0.8 m. The total width of the first and second swathes may be greater than 0.2 m, preferably greater than 0.3 m and even as much as 0.5 m.

It is however not generally possible to locate two heads next to one another without leaving a gap between. This is because, for presently available heads, the extent of the nozzles from which deposition occurs is less than the length of the head. Prior designs e.g. used in fixed arrays, have solved this problem by offsetting and staggering adjacent heads. Such an arrangement is not however directly suitable for operation in a diagonal manner in two passes, since the staggered heads cannot align on both diagonal passes. According to one aspect of the invention, by leaving an incremental width between adjacent heads a comb formation is achieved. The second swathe, deposited by the second plurality of print heads may then complete the missing areas. In the following, reference to a "comb" or "comb pattern" is intended to refer to a plurality of aligned heads, having incremental spacing between them and to the resulting deposited pattern. In general, the incremental spacing will be a single head width as this leads to a simple and compact arrangement. Nevertheless, the skilled person will understand on reading the following that other spacing may be applied in combination with alternative carriage arrangements.

According to one embodiment of the invention wherein the first and second plurality of inkjet heads are mutually aligned and each head has a head length. In this case, the alignment arrangement may comprise a spacing between the first and second plurality of inkjet heads corresponding to an even number (n=0, 2, 4 . . . ) of head lengths. In a simple case where the heads are spaced by a single head width in comb formation, the first and second pluralities may be spaced by two head lengths i.e. a double spacing. In an alternative arrangement a spacing n=0 may be achieved by using a head of double length to form both the last head of the first swathe and the first head of the second swathe.

In a second embodiment, the first and second plurality of inkjet heads are laterally offset from one another and the alignment arrangement comprises an angling device adapted to rotate the first and second plurality of inkjet heads for respective forward and reverse passes. The first and second plurality of heads may each be arranged in comb formation and staggered with respect to one another. By rotating the heads to the swathe angle at which deposition occurs, no overlap need occur on either pass. The heads may be held in fixed relation to one another and rotation may take place by rotating the complete carriage. Alternatively, individual heads may be rotated as required or as dictated by the direction of deposition with respect to the substrate.

In another embodiment, the first and second plurality of inkjet heads are laterally offset from one another and the alignment arrangement comprises an adjustment device adapted to move the first plurality of inkjet heads with respect to the second plurality of inkjet heads for forward and reverse passes. Such movement may be a reciprocating shuttle movement within the carriage, synchronised with the forward and reverse passes and may also be combined with the above described rotation. Both displacements may be controlled by software or may be linked directly to the traverse arrangement e.g. by mechanical means.

In certain embodiments the carriage may comprise further pluralities of inkjet heads adapted to deposit further swathes of the same or a different substance. These may be arranged as a plurality of rows of print heads, stacked in the traverse (Y) direction with respect to one another. If each row deposits the same substance, the extra heads may be used to increase the printing definition in the traverse direction e.g. by printing at interlacing positions. Alternatively, each row may deposit a different substance: in the case of a CMYK head, four rows of heads may be provided. It should thus be understood that, in general, there will be at least two groups of heads for each colour. For a CMYK colour system this will require a total of at least eight groups of heads. For a CMY system, six groups may be used. Building up the print carriage with multiple heads in this manner can increase its width in the traverse direction, requiring either a longer traverse or giving a narrower effective printing width.

In the present context, the term inkjet head is understood to define any device that can bring a plurality of small droplets or jets of fluid to individually defined precise locations on a substrate. The term is intended to encompass DoD, piezoelectric, thermal, bubble jet, valve jet, CU, electrostatic heads and MEMS systems. The system according to the invention is independent of the specific heads used, whether they be supplied by e.g. Xaar™, Fuji Film™, Dimatix™, Hewlett-Packard™, Canon™, Epson or Videojet™. Preferably the inkjet heads are of the drop on demand (DoD) type. Such heads are presently most preferred for their reliability and relatively low cost. Most preferably, the inkjet heads provide grey-scale droplet deposition which allows an additional degree of freedom of deposition e.g. when operating in diagonal mode. Previously it had been considered desirable to operate at defined swathe angles in order to allow individual droplet placement at defined matrix locations. This principle was believed to apply both to graphic printing and to textile finishing in order to ensure uniform coverage. It has however been found that by using software adaptation to control deposition volume and position, moiré effects and the like may be avoided irrespective of the swathe angle. It is noted that this principle is applicable both to single carriage deposition and also to systems where each swathe is deposited from a different carriage.

The present invention also relates to a printer, comprising a substrate transport device for continuously transporting a supply of substrate in a transport direction and a print carriage as described above, arranged to traverse across the substrate for deposition of the substance in first and second complementary swathes. The transport device is preferably adapted to operate at substrate speeds of at least 5 m/min, preferably 10 m/min and more preferably above 20 m/min with substrates widths of greater than 1 m, preferably greater than 1.4 m and most preferably greater than 1.6 m.

The printer may also preferably comprise a beam upon which the print carriage is mounted for traversing the substrate. Nevertheless, alternative arrangements may also be envisaged e.g. a traversing robot arm.

In a preferred embodiment, the carriage may be mounted on a beam forming part of a linear motor for moving the print carriage. Such linear motor arrangements are ideal for ensuring improved accuracy of carriage positioning and may be constructed in a robust manner. They furthermore can have the advantages of smoother motion and lack of vibration when compared with other drive arrangements.

The printer may further comprise a control arrangement for synchronising a traverse speed or position of the print carriage to a transport speed or position of the substrate in order to ensure substantially uniform coverage of the substrate by the substance.

The printer may also comprise an encoder or other form of reading device, arranged to read the substrate and provide information to the control arrangement for guiding the deposition of the substance. The reading device may directly read a position or speed of movement of the substrate by following e.g. the weft of a textile. Alternatively, it may read indications printed or otherwise provided on the substrate or the transport device in the form of encoder markings or the like. It may also read the position based on prior deposited droplets. In this way, the carriage may be synchronised on its return pass or a subsequent carriage may be guided by e.g. the individual droplets or the edge of the swathe as deposited by a previous head. The reading of the substrate may be used to guide the speed or position of one or more of the carriages. It may also be used to guide individual nozzles forming the heads or to guide operation of a touch-up head. Furthermore, although optical e.g. laser readers may be preferred, any other suitable reader allowing position feedback may also be employed, not limited to optical, tactile and mechanical devices.

Although the invention has been described in relation to a single carriage, additional carriages may be provided for certain reasons. In order to reduce the traverse distance (and hence the traverse time), a pair of print carriages may be provided whereby each print carriage traverses a respective half of the width of the substrate to deposit the substance. The print carriages may both traverse on the same beam and each may receive maintenance at a respective edge with stitching taking place at the midline. Alternatively or additionally, further carriages may be located upstream or downstream of the first carriage in order to provide further coverage of the same substance or deposit different substances e.g. where an image or functionality is built up in a number of stages.

In a further preferred embodiment for deposition onto a textile, the transport device comprises an attachment arrangement to prevent shifting of the substrate during deposition. Such shifting may be very detrimental to accurate deposition, especially where a subsequent beam or carriage deposits another part of an image. Textiles are known to be sensitive to movement and distortion. Suitable attachment arrangements may comprise adhesive belts, vacuum, stenters and the like. It is however also within the scope of the present invention that the method may also be applied to individual items such as tiles, plates, sheets, clothing articles or the like, that are transported through the printing arrangement in a continuous manner.

The invention also relates to a method of depositing a substance onto a continuously moving substrate in first and second transverse swathes, the method comprising providing a print carriage comprising a first plurality of inkjet heads and a second plurality of inkjet heads; traversing the print carriage across the substrate in a forward pass, while depositing the first and second swathes from the respective first and second plurality of inkjet heads; subsequently traversing the print carriage across the substrate in a reverse pass; aligning the first and second plurality of inkjet heads such that the first and second swathes complement one another on both forward and reverse passes; and repeating the forward and reverse passes to provide substantially complete coverage of the substrate. By operating continuously according to the invention, substrate speeds of at least 5 m/min, preferably 10 m/min and more preferably above 20 m/min may be achieved with substrate widths of greater than 1 m, preferably greater than 1.4 m and most preferably greater than 1.6 m.

In this context, it is important to note that substantially complete coverage of the substrate is intended to refer to the ability of the carriage to address all areas of the substrate where deposition is intended. It is thus not necessary that actual deposition takes place at all positions. Printing of an image or pattern may require selective deposition, while application of a coating may require substantially complete coverage. It is also not a requirement that the totality of the substrate receives the uniform coverage. There may thus remain uncovered edge regions where deposition of the substance is not intended. Furthermore, although under most circumstances deposition will take place directly onto the final substrate, the present invention is also intended to cover indirect deposition e.g. onto a transfer reel or medium, which is subsequently applied to the substrate.

The method according to the invention preferably comprises performing maintenance on the inkjet heads between the forward and reverse passes. This may take place for all of the heads of the carriage or just for certain subgroups after each pass. The maintenance may take place while the head is stopped or during the movement of turnaround.

The method also preferably comprises synchronising a traverse speed or position of the print carriage to a transport speed or position of the substrate to ensure alignment of a forward pass of the first swathe with a subsequent forward pass. This may be achieved on the basis of e.g. software control and encoder feedback of the substrate position. Preferably, the carriage is slaved to the substrate transport such that on reducing the transport speed the carriage speed also reduces accordingly. In this manner, the swathe angle remains constant for any substrate speed and the amount of calibration required is significantly reduced. Mechanical and hardware embodiments may also be used to achieve such synchronisation.

In addition to controlling synchronisation and alignment at a macro or swathe level, the device may also be controlled to provide synchronisation and alignment at a micro or pixel level e.g. to ensure correct stitching between swathes. This may involve the use of conventional stitching software to reduce alignment perturbations between passes. It may also involve adjusting the volume of substance deposited by each drop e.g. using grey-scale type inkjet heads. This may be used in order to reduce moiré effects when droplets on different passes overlay one another. It may also be used to avoid colour variations where droplets of two different colours are overlaid in different order. Further preferred methods may involve the use of software including a dither function to provide accurate colour or shade reproduction e.g. by error diffusion or blending.

In certain embodiments of the method, the first plurality of inkjet heads may be stacked in the traverse direction and the method comprises printing at a resolution in the traverse direction that is reduced according to the degree of stacking. In this context, stacking is understood to mean that a plurality of heads is arranged such that the individual rows of nozzles lie parallel to one another, offset in the traverse (Y) direction. If these nozzles print the same substance, they may used to deposit droplets onto the substrate at positions that interlace with each other whereby each row operates at half (or another sub-multiple) of the final definition.

In one embodiment of the method, the substrate is a textile and the substance is an ink or dye and the method comprises uniform application of the dye over substantially the whole surface of the textile. Achieving a deposition of a single colour at a uniformity equivalent to conventional dying procedures is extremely difficult. Any slight stitching inaccuracy or nozzle failure becomes most evident when viewed against a plain background. By using the method described above significantly better results have been achieved.

In a textile printing embodiment, the substrate is a textile and the substance is an ink or dye. In this case, the method comprises controlling application of the dye to form a monochrome image on the textile, whereby part of the image is formed by the first swathe and another part of the image is formed by the second swathe. By providing further pluralities of colour heads on the same or different carriages, a coloured image may be built up In a finishing embodiment of the invention the substrate is a textile and the heads are finishing heads. In this case, the method comprises applying a finishing composition to the textile. In this context, a finishing composition is understood as being a chemical that alters the physical and/or mechanical characteristics of the textile. Finishing techniques are meant to improve the properties and/or add properties to the final product. In this context, finishing may be distinguished as a species of printing by optionally defining it to exclude treatments involving deposition of materials that are applied to the substrate only because of their absorption properties at wavelengths between 400 nm and 700 nm or involving the recording of information. The finishing composition may be any finish appropriate for being deposited using the chosen deposition arrangement. In fact the choice of finishing head may be selected according to the nature of the finish required. In particular, the finishing composition may be selected from the group consisting of anti-static, anti-microbial, anti-viral, anti-fungal, medicinal, non-crease, flame-retardant, water-repellent, UV-protective, anti-odour, wear-resistant, stain-resistant, self-cleaning, adhesive, stiffening, softening, elasticity-enhancing, pigment-binding, conducting, semi-conducting, photo-sensitive, photo-voltaic, light-emitting, optical brightening, shrink resistant, handle imparting, filling & stiffening, weighting, softening, oil-repellent, soil repellent, soil release, felting, anti-felting, conditioning, lustring, delustring, non-slip, moisture vapour transport, anti-snagging, anti-microbiotic, reflecting, controlled release, indicating, phase changing, hydrophilic, hydrophobic, sensory, abrasion resistant and wetting agents.

The invention also relates to a continuous substrate having deposited thereon a substance, the substance being deposited as individual droplets arranged in complementary diagonal swathes, wherein the droplets are of varying sizes (greyscale) and/or are deposited at non-regular positions on the substrate to provide a substantially uniform coverage. In this context, reference to droplets of varying sizes is understood to cover droplets that can be produced at a number of different predetermined volumes. It is not intended to cover the inherently variability of any droplet dispensing device. Reference to non-regular positions is intended to denote that the droplets are not arranged in defined vertically and horizontally aligned matrix positions. It may also include droplets that are randomly placed e.g. within a given pixel area. Reference to uniform coverage in this context is intended to refer to local uniformity of deposition i.e. without moiré effects and light and dark areas.

Preferably, there are provided first and second complementary swathes which are directly out of phase with each other. The droplets of the first swathe may be interlaced between droplets of the second swathe to provide the substantially uniform coverage. The first swathe may provide about 50% of the coverage of the substrate and the second swathe may provide the remainder.

The invention also relates to a continuous substrate having deposited thereon a substance, the substance being deposited as individual droplets arranged in complementary diagonal swathes, wherein the swathes are stitched with respect to one another along generally diagonal stitch lines to adjust for disparities in swathe alignment. The stitching may take place using generally conventional stitching methods and appropriate software, adapted for operation on a diagonal swathe. One preferred principle is the defined overlap region stitch whereby the heads are mechanically mounted to overlap one another. The nozzles can then be turned off using software to give the desired alignment with an accuracy of half a pixel. A system of this type is described in U.S. Pat. No. 4,977,410 assigned to Seiko Instruments Inc, the contents of which are incorporated by reference in their entirety. Another preferred stitch is the randomised overlap stitch in which the overlap region is defined (mechanically) and whereby the pixels in the overlap region are distributed randomly for printing by either one print head or the other. Such a principle is described in U.S. Pat. No. 5,450,099 assigned to the Eastman Kodak Co, the contents of which are incorporated by reference in their entirety.

The substrate is most preferably a textile. In the present context the term textile may be chosen to exclude paper, carton and other substrates that are two-dimensionally stable i.e. those that are flexible in a third dimension but are only marginally deformable within their own plane. In the same context, a textile may be understood to cover a flexible substrate formed from natural or artificial fibres or yarns by weaving, knitting, crocheting, knotting, pressing or otherwise joining the fibres or yarns together, which is stretchable or otherwise deformable in its own plane. Such textile may be supplied from a roll or the like in a length that is significantly greater than its width. Other substrates on which the invention may be performed may include paper or card based materials, film materials, foils, laminates such as wood-look melamine and any other material susceptible to transport in a continuous manner.

BRIEF DESCRIPTION OF THE DRAWINGS

The features and advantages of the invention will be appreciated upon reference to the following drawings, in which.

DESCRIPTION OF ILLUSTRATIVE EMBODIMENTS

The following is a description of certain embodiments of the invention, given by way of example only and with reference to the drawings.

Figure 1:
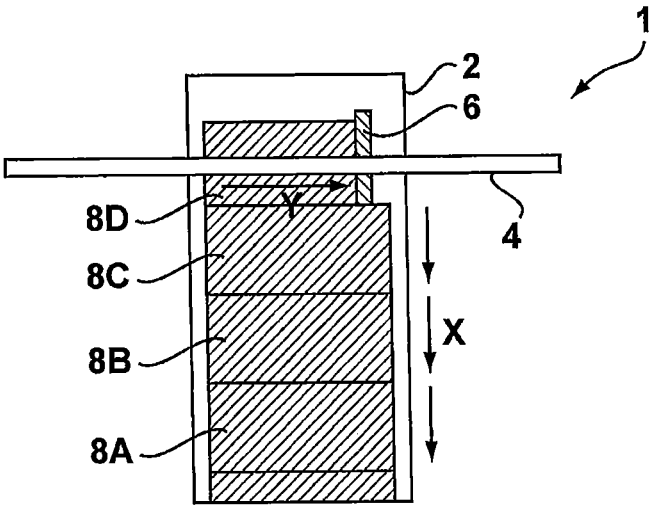
FIG. 1 is a schematic view of a conventional traverse printing arrangement.

Referring to FIG. 1, a conventional traverse print head system 1 is shown for printing onto a substrate 2 using inkjet techniques. The substrate 2 is transported in a direction X past a beam 4 on which is mounted a traversing inkjet print head 6 comprising a multitude of nozzles. In operation, the print head 6 traverses the substrate 2 in direction Y and prints a first pass 8A across the substrate having a width corresponding to the length of the print head 6. Although shown as a uniform layer, pass 8A is actually composed of thousands of tiny droplets or pixels. The substrate 2 is then moved forward an increment corresponding to the width of the pass 8A and halted. The print head 6 then traverses back across the substrate 2 to produce a second pass 8B. Further passes 8C, 8D are performed in the same manner. In practice, variations to this procedure are carried out in which the passes may overlap or which use interlacing and interweaving to place the individual droplets of one pass between those of another. A disadvantage of such a system is that the movement of the substrate is intermittent and high printing speeds are difficult to achieve.

Figure 2:
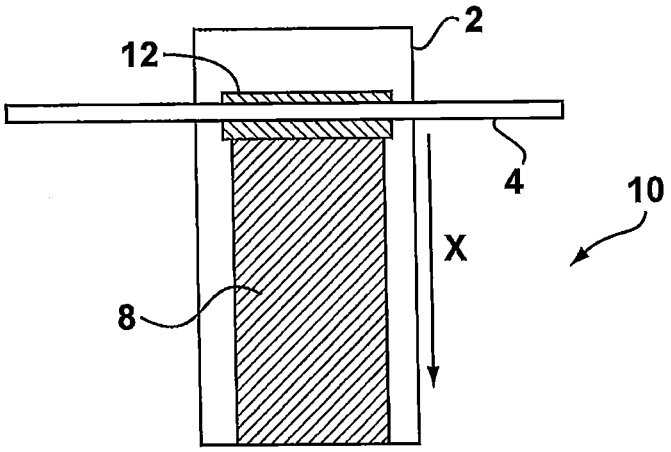
FIG. 2 is a schematic view of a conventional fixed array printing arrangement.

FIG. 2 shows a conventional fixed array printing system 10 in which a substrate 2 is transported in a direction X past a beam 4 on which a fixed head 12 is mounted. Fixed head 12 spans substantially the full width of the substrate 2. In operation, as the substrate 2 is moved, printing takes place and a pass 8 is produced over the substrate width corresponding to the width of the fixed head 12. Although this system 10 allows the substrate 2 to move continuously, frequent stoppages are necessary for preventative maintenance and repair of the head 6 or individual nozzles. Furthermore, for a given print head, only one transverse print resolution may be achieved corresponding to the nozzle spacing of the head.

Figure 3:
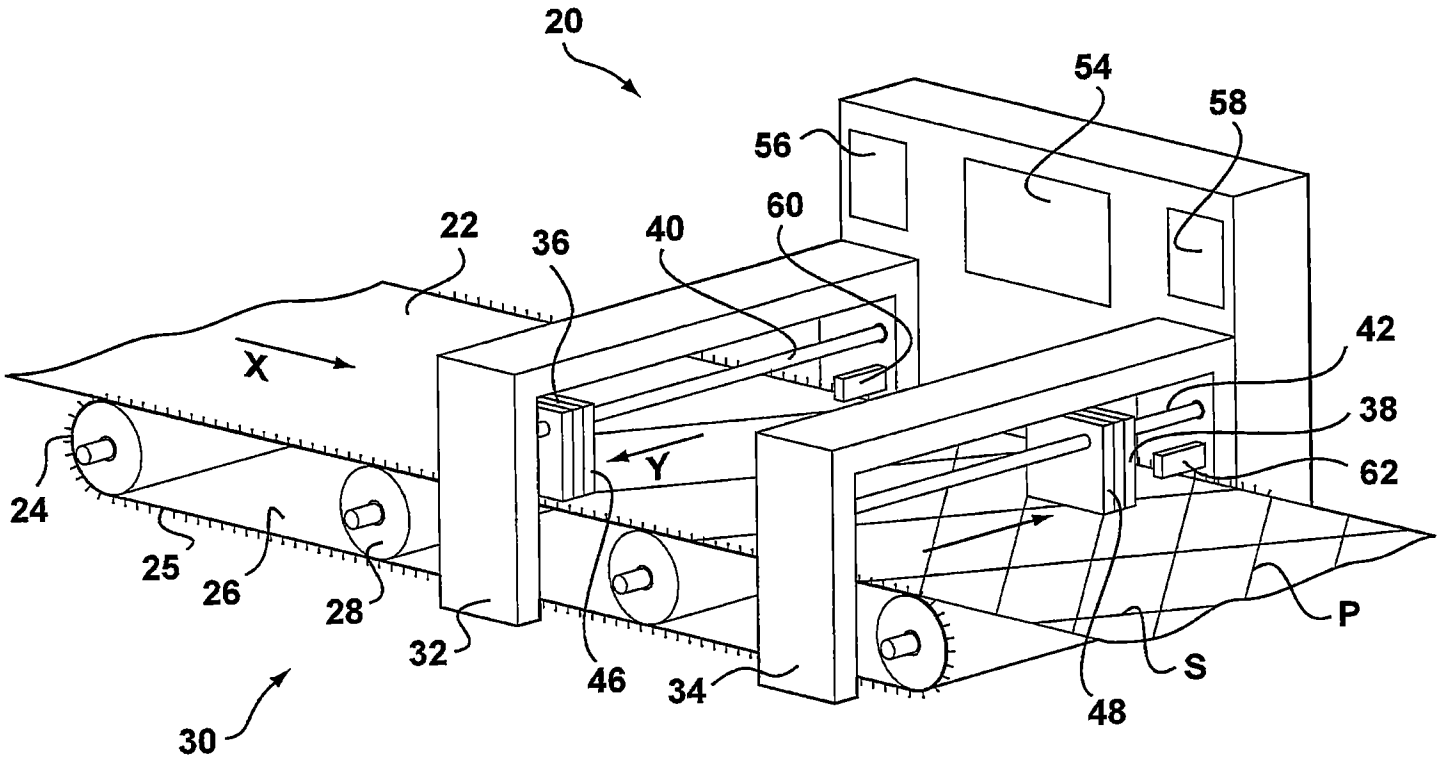
FIG. 3 is perspective view of a diagonal mode printing arrangement.

FIG. 3 shows a perspective overview of a printing arrangement 20 for printing a textile substrate 22 as described in WO02009/056641. The operation of that device is useful in appreciating the present invention and is therefore explained in some detail in the following.

According to FIG. 3, the substrate 22 is supplied from a continuous supply such as a roll or J-frame or the like (not shown) and has a width of 1.6 m. A transport arrangement 24 in the form of a conveyor band 26 driven around a number of roller elements 28 carries the substrate 22 in a continuous manner through a deposition arrangement 30 in direction X at a maximum operational speed of about 20 m/min. In order to avoid relative movement between the band 26 and substrate 22, stenter pins 25 are carried by the band 26 to retain the substrate 22. The skilled person will be aware that other appropriate attachment arrangements may be provided if desired, to temporarily retain the substrate, including adhesive, vacuum, hooks and the like.

Deposition arrangement 30 comprises a first beam 32 and a second beam 34 spanning the substrate 22. First and second carriages 36, 38 are arranged for reciprocal movement along traverse mechanisms 40, 42 across the respective beam 32, 34 in a direction Y. Movement of the first and second carriages 36, 38 is by appropriate motors (not shown) as generally used for printing carriages of this format. Carriage 36 carries a plurality of inkjet heads 46. Carriage 38 is similarly arranged with several inkjet heads 48. The inkjet heads are Xaar Omnidot™ 760 drop on demand inkjet heads having a resolution of 360 dpi and capable of producing variable drop volumes from 8 to 40 pl using grey-scale control. The nozzles in each head are arranged in two back to back rows of 380 nozzles. Each carriage 36, 38 has a total head length in the X direction of 0.8 m.

Printing arrangement 20 additionally comprises a controller 54 and ink supplies 56, 58 for the first and second beams 32, 34 respectively. The ink supplies 56, 58 may comprise individual reservoirs and pumps (not shown) for each of the heads 46, 48. In the present context, although reference is made to ink, it is understood that this term applies to any substance intended for deposition onto the substrate and that inkjet head is intended to refer to any device suitable for applying that substance in a drop-wise manner. Above the substrate 22, adjacent to beams 32, 34 are located optical encoders 60, 62, the function of which will be described below. FIG. 3 also shows primary P and secondary S swathes deposited on the substrate 22.

Operation of a deposition arrangement 30 of the type depicted in FIG. 3, will be described with reference to FIG. 4, which shows a schematic view of the deposition arrangement 30 from above, showing substrate 22, first beam 32, second beam 34, first carriage 36 and second carriage 38. For the sake of the present description, the carriages 36, 38 are considered to operate with only a single head, although it will be understood that the principle applies equally if more heads on each carriage operate.

As can be seen, carriage 36 traverses in direction Y across the substrate 22 depositing a forward pass P1 of a primary swathe as substrate moves in direction X. As a result, P1 is generally diagonal having a swathe angle $\alpha$ determined by the relative speeds of transport and traverse motion. In previous traverses of the substrate 22, the carriage 36 has deposited passes P2, P3 and P4. The passes P1 and P2 have overlapped in the overlap region 71. Passes P2 and P3 have also overlapped in overlap region 72 as have passes P3 and P4 at overlap region 73. At the point of time depicted by FIG. 4, carriage 38 traverses the substrate 22 in a direction opposite to Y depositing a forward pass S1 of secondary swathe. In a previous traverse in the direction Y, carriage 38 has deposited passes S2, partially overlapping with S1 in the overlap region 74.

The primary P and secondary S swathes also cross one another in the centre of the substrate 22 in crossing regions 75 and 76. As can be seen, primary P and secondary S swathes are arranged to complement one another exactly. As a result, every region of the substrate 22 is eventually passed over by two swathes: either twice by carriage 36; twice by carriage 38; or once by each of the carriages. The resulting deposition is perfectly uniform across the whole substrate.

Figure 5:
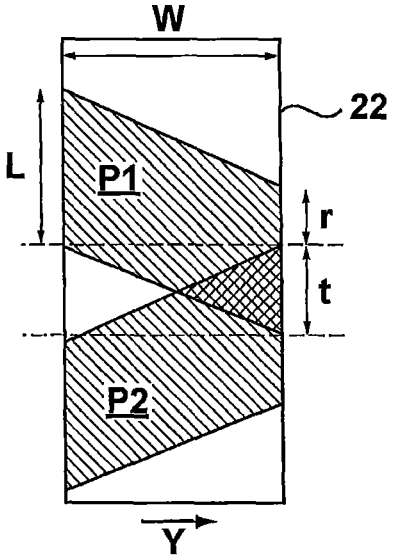
FIG. 5 is a schematic view of a portion of substrate showing deposition according to the invention.

FIG. 5 discloses in further detail the manner in which the forward and reverse passes P1, P2 are set down onto the substrate 22 which has a width w. Details of the deposition arrangement 30 have been omitted for the sake of clarity. In a forward traverse in direction Y, pass P1 has been deposited. During the traverse, substrate 22 moves a transport distance t with respect to the carriage in the transport direction X. The carriage 36 then passes beyond the edge of the substrate 22 where maintenance is performed off-line during a pause in its movement. During this pause, the nozzles of the inkjet head are all fired and the face plate of the head is wiped clean of residue. The time taken for turn around of the carriage 36 is approximately 2 s. During this time, the substrate 22 advances further in the direction X by a rest distance r. By choosing t and r to correspond to the head length 1 of carriage 36, the space between successive passes in the same direction P1, P3 will correspond to the width of a swathe—and to the width of subsequent carriage 38, given that both carriages deposit the same width. This corresponds to the case where the width of a swathe is equal to half of the period of the cycle of operation of the deposition arrangement 30. By operating the second carriage 38 in counter-phase with the first carriage 36, uniform coverage of the substrate 22 is achieved.

Figure 4:
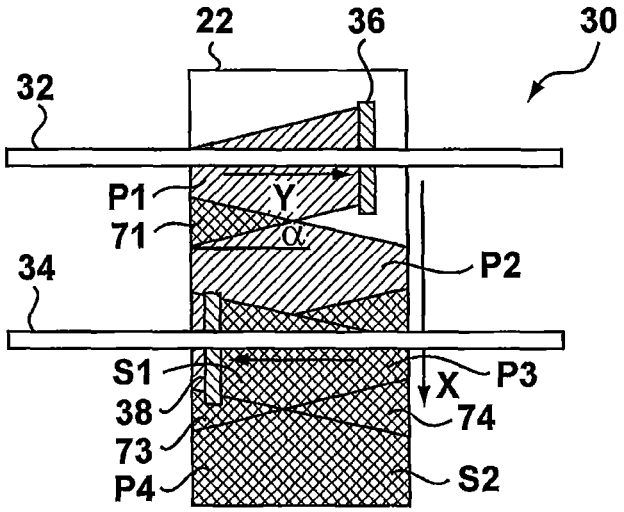
FIG. 4 is a schematic view illustrating the principle of operation of the device of FIG. 3.

According to the embodiment described in relation to FIGS. 4 and 5, the deposition arrangement may operate at different swathe angles $\alpha$, subject to the head length l being equal to the sum of the transport distance t and the rest distance r (or a multiple thereof).

Figure 6:
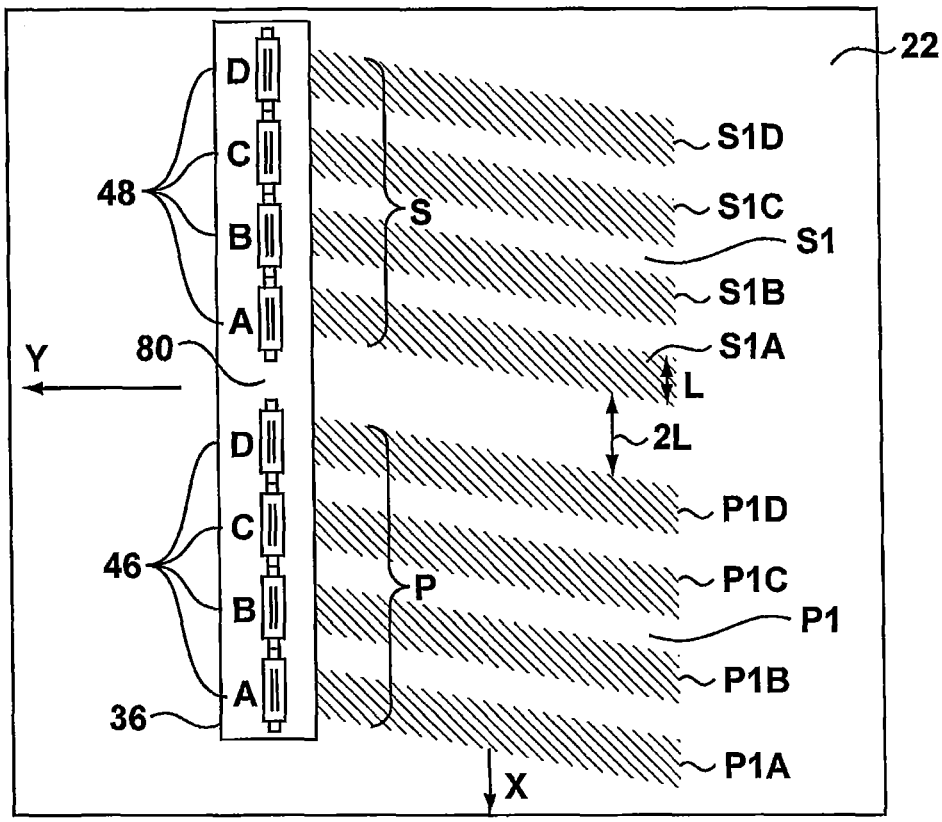
FIG. 6 shows a printing carriage according to a first embodiment of the invention.

According to FIG. 6, a first embodiment of a single carriage print arrangement according to the invention is depicted in which, for the sake of clarity, only the positions of the heads and nozzles are shown. Like reference numerals denote corresponding elements to those of FIGS. 1 to 5.

The print carriage 36 comprises a first set 46 of print heads 46 A-D and a second set 48 of print heads 48 A-D. The print heads in each set 46, 48 are Xaar Omnidot™ 760 as those of FIGS. 1 to 5 and each has a head length l. This length l is the effective width over which the head can deposit the substance to be printed and need not correspond to the physical length of the head itself. The print heads are also mutually spaced from adjacent heads within the set by the same distance l. Such a distribution of print heads is hereafter referred to as a comb formation, since operation of the carriage may deposit a substance onto the surface of substrate 22 in swathes P, S as if a comb had been drawn over the surface. Forward passes P1, S1 of the first and second sets 46, 48 are shown. The advantages of such a comb formation in producing extended heads has been previously described in WO2009/056641.

According to the present invention, an alignment arrangement 80 is provided between the first set 46 and second set 48 of print heads. In the embodiment of FIG. 6, this alignment arrangement is a double sized head spacing corresponding to the distance 21. The manner in which the alignment arrangement 80 achieves the desired result will now be described in further detail in relation to FIG. 6.

In operation, the carriage 36 is driven to traverse across the substrate 22 to deposit passes P1, S1 of primary and secondary swathes P, S whereby pass P1 has been deposited by first set 46 and pass S1 has been deposited by second set 48. The heads are driven to deposit at 180 dpi in the traverse direction. As described above, the spacing between adjacent heads 46 A-D and 48 A-D leads to each swathe P, S being deposited as a series of equally spaced bands and spaces. For the purposes of the description, these passes are designated P1A, P1B, S1D etc, where P1A is the forward pass of the primary swathe P, deposited by head 46A and S1D is the forward pass of the secondary swathe S, deposited by head 48D. As also described above in relation to FIGS. 4 and 5, by adjusting the traverse speed with respect to the transport speed, two traverses of the carriage including a maintenance pause (i.e. a full cycle) may be made within the time needed for the substrate to move the length of the first set 46 of heads. In the case of the four heads 46A-D of FIG. 6, this distance corresponds to 81, namely four head lengths and four inter-head spaces. In this manner, the carriage 36 returns to a starting position that will allow it to lay down a subsequent pass that is precisely in phase with the first pass P1.

By aligning the second set 48 comprising heads 48 A-D with the first head 46 and spacing them by a distance 21, the secondary swathe S deposited by the second set 48 will always be precisely out of phase with the primary swathe P deposited by the first set 46. This ensures that the two comb formations align and interlace and that each point on the substrate is addressed twice, by the same or a different head. Since the heads are all driven at 180 dpi in the traverse direction, the resolution after two passes will be 360 dpi, corresponding to the definition in the transport direction (in this case as defined by the head). Although in FIG. 6, a double head spacing is used for alignment, it will be understood that alternative spacings can be used. In particular, by using a double length head to replace heads 46D and 48A, the same effect may be achieved with a total carriage length reduction of 21. It may be noted in relation to FIG. 6 that since two rows of nozzles are provided in each head, a shadowing at the swathe edges may occur. This may be overcome by turning off certain nozzles on each path. Furthermore, for graphic printing, certain swathe angles allowing interleaving of droplets from both rows may be more favourable.

Figure 7:
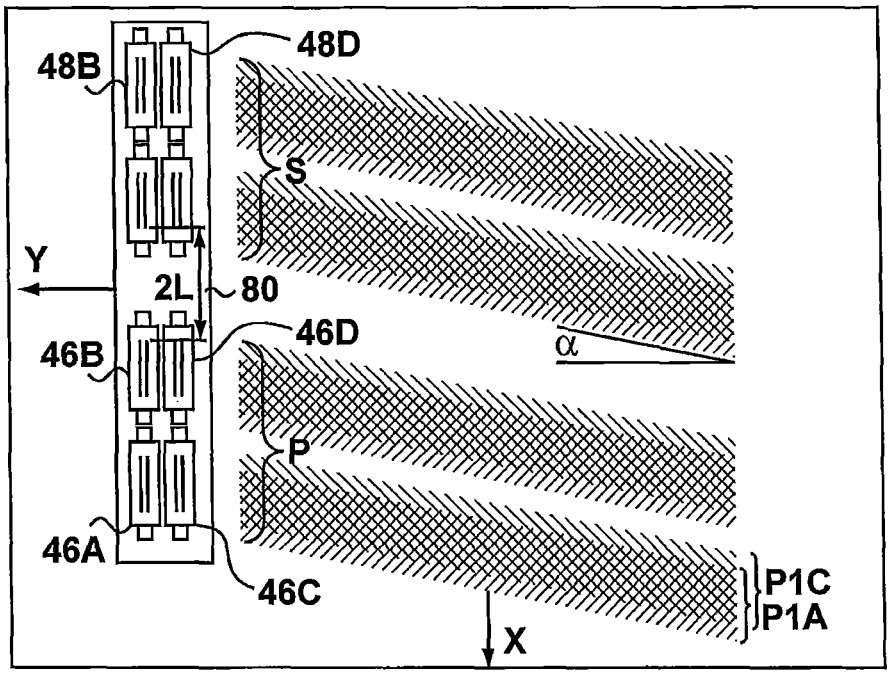
FIG. 7 shows a printing carriage according to a second embodiment of the invention.

A second embodiment of carriage 36 is shown in FIG. 7 in which heads 46 A-D are stacked in two rows, offset from one another in the traverse direction. The heads 48 A-D of the second set 48 are also stacked in a similar manner. As was the case in the embodiment of FIG. 6, the heads 46 A, B are spaced by a distance l, as are the heads 48 A, B, 46 C, D and 48 C, D. Furthermore, according to the invention an alignment means 80 in the form of a double spacing 21 is provided between the first set 46 and the second set 48.

In use all of the heads of the carriage 36 are used to deposit the same substance onto the substrate 22 in primary and secondary swathes P, S. In this case, the heads are driven to deposit at a resolution of 90 dpi in the traverse direction. Stacking of the heads causes areas of the first pass P1 to be printed twice by both heads 46A and 46C, achieving a resultant definition for the first pass P1 of 180 dpi. Other areas are twice printed by heads 46B and 46 D. Since the carriage 36 is printing on a diagonal, the passes P1A and P1C only partially overlap. The same applies to the second set 48, in which passes S1A and S1C partially overlap.

As in the case of FIG. 6, the carriage 36 is driven to return to a position that is in phase with the initial position. The secondary swathe S is precisely out of phase with the primary swathe and, as a result, the passes deposited by heads 48 A and B will interlace with those of heads 46 A and B, while the passes deposited by heads 48 C and D will interleave with those of heads 46 C and D.

In traversing the substrate, since the length of each set 46, 48 of heads is in this case only 41, the carriage must travel at twice the speed (given the same textile width and transport speed) and the swathe angle $\alpha$ will be correspondingly smaller. The fact that the heads are stacked thus reduces the overall length of the carriage 36 but requires a corresponding increase in traverse speed. Also, because the heads are stacked, the carriage becomes wider and has to traverse further than in the embodiment of FIG. 6 in order to pass beyond the edge of the substrate. It will be understood that more than two rows of heads may be stacked with a corresponding reduction in scanning resolution per stack. For a four row stack, printing at 45 dpi in the scanning direction would be sufficient to achieve overall definition of 360 dpi.

In the embodiment of FIG. 7, heads 46 A to D are treated as a single set 46, producing a primary swathe P by deposition of a single substance. It will also be understood that heads 46 A, B may be used to form a first set for deposition of a first substance and heads 46 C, D may be used as a first set for deposition of a second substance. In each case, the heads 46 A to D will always be complemented by a corresponding head 48 A to D ensuring full coverage for each of the deposited substances.

Figure 8:
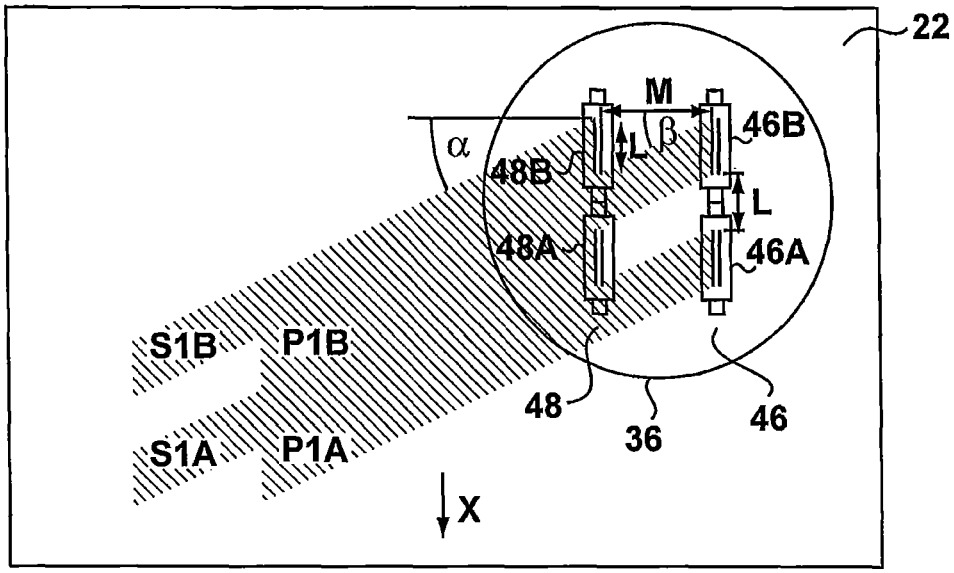
FIG. 8 shows a printing carriage according to a third embodiment of the invention.

FIG. 8 shows part of a carriage 36 according to a third embodiment of the invention having an alternative arrangement of heads in two sets 46, 48. The heads 46A, B . . . in the first set (only the first two heads are shown) are arranged in comb formation with a head spacing 1. The heads 48 A, B, . . . are also arranged in a similar formation and are offset laterally from the first set 46 by a distance m which serves as an alignment arrangement 80. As can be seen from FIG. 8, at an angle $\beta$, the swathe P1B deposited by head 46B passes perfectly between the heads 48 A, B and can complement the swathes S1A, S1B deposited by these heads. For this to occur, the swathe angle $\alpha$ must be set equal to angle $\beta$=arctan l/m. The skilled person will understand that since the spacings are equal for each set 46, 48, the heads will also complement each other on the reverse pass when driven at the same angle. The embodiment is however limited to only this swathe angle.

Figure 9:
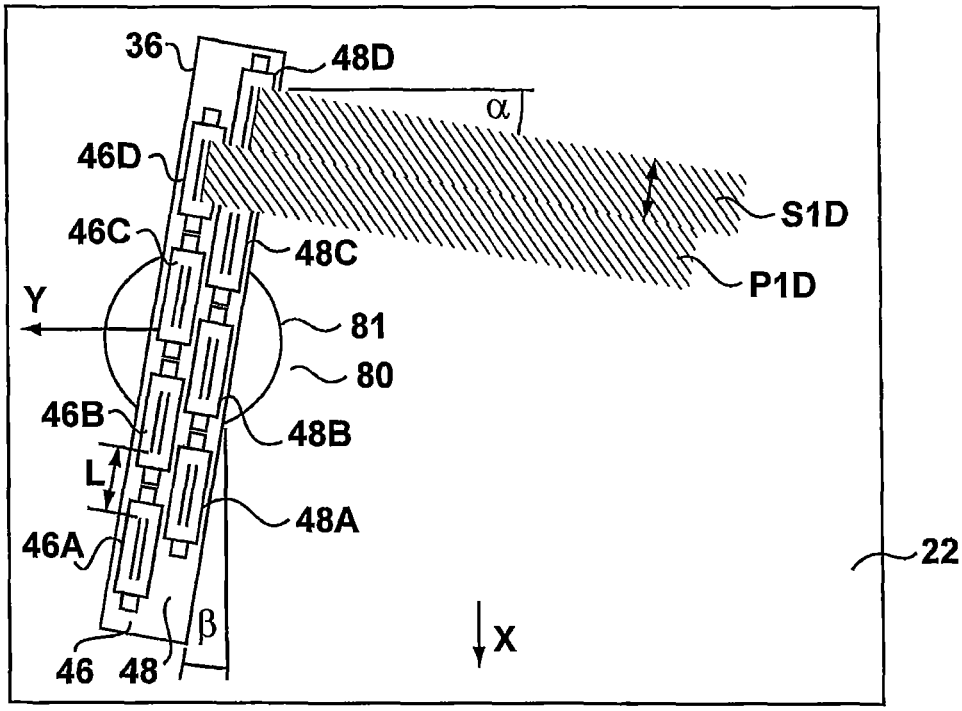
FIG. 9 shows a printing carriage according to a fourth embodiment of the invention.
Figure 10:
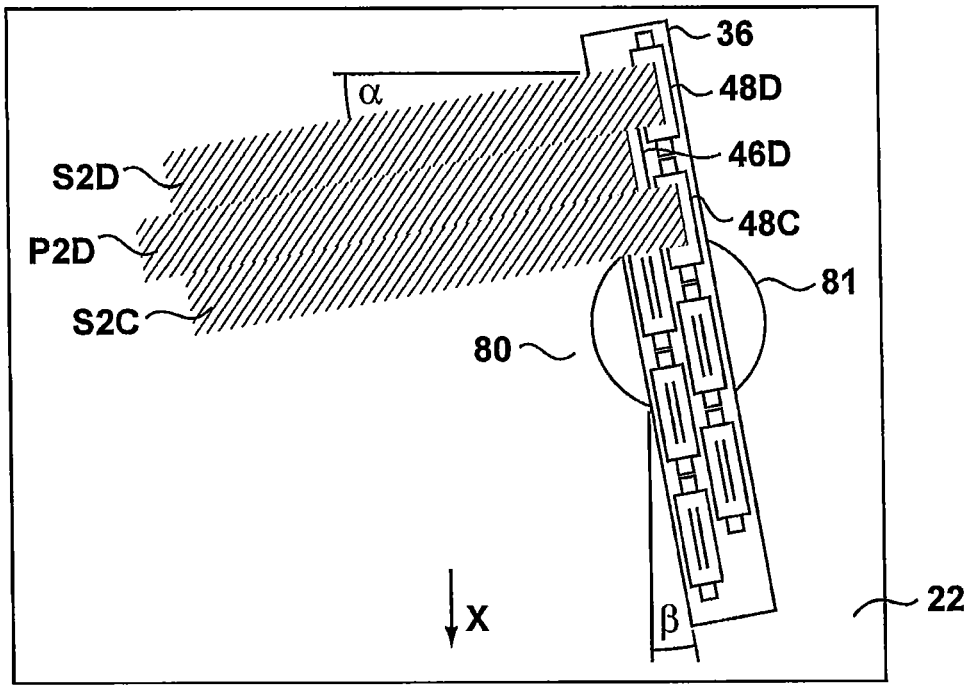
FIG. 10 shows operation of the printing carriage of FIG. 9.

In the fourth embodiment of FIGS. 9 and 10, the carriage 36 is provided with an active alignment arrangement 80 in the form of a rotating connection 81 between the carriage 36 and the beam (not shown) upon which it traverses. As in the previous embodiments, the alignment arrangement 80 ensures that the primary P and secondary S swathes complement one another. With reference to FIG. 9, carriage 36 comprises a first set 46 of print heads 46 A-D and a second set 48 of print heads 48 A-D. The heads 46 A-D are aligned with one another in comb formation in similar manner to that described in FIG. 6, whereby a spacing l is maintained between adjacent heads. The heads 48 A-D are aligned in a similar manner with one another. Contrary to the arrangement of FIG. 6 however, according to FIG. 9, the first set 46 is offset and staggered with respect to the second set 48.

In use, the carriage 36 is rotated at rotating connection 81 with respect to the direction of substrate movement X by a rotation angle β. Rotation may take place by any appropriate means (not shown) including motors, actuators, springs, cams, links and the like. The carriage 36 is then driven to traverse the substrate 22 in the direction Y as the substrate moves continuously in the direction X. As it moves, the heads 46 A-D and 48 A-D deposit respective primary and secondary swathes in a forward pass, of which passes P1D and S1D respectively deposited by heads 46D and 48 D are shown. The relative motion of carriage 36 and substrate is controlled such that the passes are deposited at swathe angle α. In order to avoid the second set 48 from lagging with respect to the first set 46 during the forward pass, rotation angle β is chosen to be equal to the swathe angle α. As can be seen from FIG. 9, this causes the passes P1D and S1D to align and the skilled person will understand that this will apply to all the individual forward passes of the primary and secondary swathes. It will be understood that operation in this manner also advantageously prevents possible misalignment between the nozzles of respective rows within a single head.

FIG. 10 depicts the position of the carriage 36 after completion of a reverse pass across the substrate 22. For the reverse pass, the carriage 36 has been rotated at rotating connection 81 to a rotation angle β opposite to that of FIG. 9. Rotation of the carriage takes place off-line at the edge of the substrate 22 and may be carried out during maintenance of the heads. As a result of this rotation, the reverse passes (of which S2C, P2D and S2 D are shown) of the primary and secondary swathes also align with one another. For the sake of completeness, it may be noted that although the passes P1D, S1D . . . S2D are shown having staggered starts and finishes, this need not be the case. The individual nozzles carried by the heads 46A-D, 48A-D would under normal circumstances be driven to commence deposition at a straight line or edge of the substrate.

Figure 11:
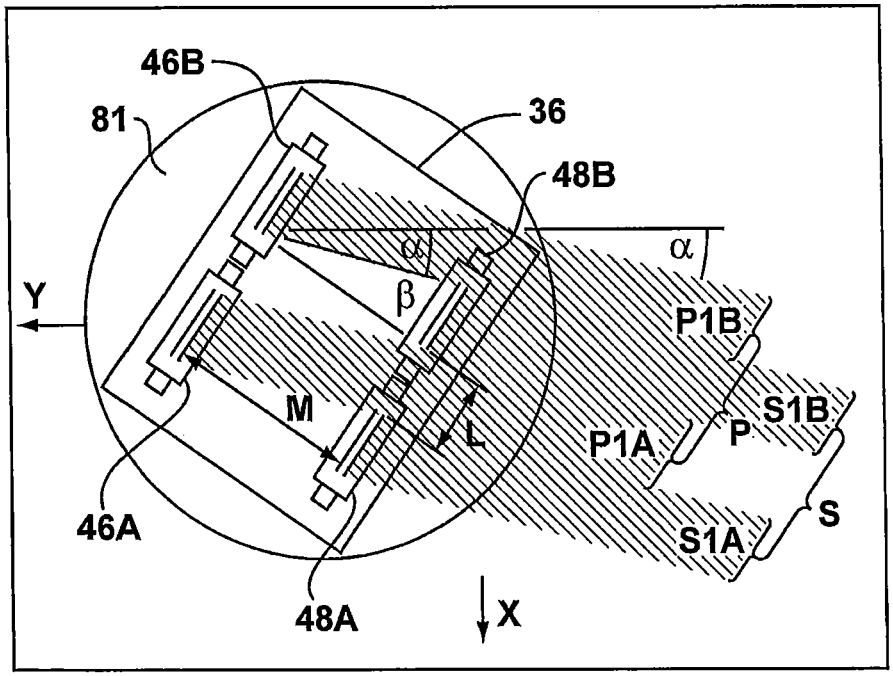
FIG. 11 shows a printing carriage according to a fifth embodiment of the invention.

An alternative rotating carriage arrangement according to a fifth embodiment of the invention is shown in FIG. 11, which allows the principle of FIG. 8 to be applied at varying swathe angles. Carriage 36 is mounted on a rotating connection 81 and carries a first set 46 of heads 46A, B and a second set 48 of heads 48A, B, mutually spaced by the headlength l. As in FIG. 8, the heads 46A, B and 48A, B are offset from one another or stacked by a distance m, but not staggered. In use, the carriage 36 is driven to traverse the substrate in a forward pass to deposit primary and secondary swathes at the swathe angle α. The rotating connection 81 is turned to a rotation angle at which the forward passes P1A, S1A, P1B, S1B stitch together. In this embodiment, this is the point at which the swathe is angled to the carriage by $\beta = \arctan l/m$ and where the rotation angle of the carriage is $\alpha+\beta$. For a reverse pass, the rotating connection 81 will be turned in the opposite direction by a similar amount. The skilled person will also understand that the carriage arrangement of FIG. 11 may also be rotated to a rotation $\alpha-\beta$.

In a non-shown embodiment, a similar effect to the rotation of FIGS. 9, 10 and 11 may be achieved by linear movement of the first set 46 with respect to the second set 48. For two sets of heads that are stacked or offset with respect to one another, shuttling one set with respect to the other allows the degree of lead or lag of the respective set to be adapted to match the swathe angle.

Figure 12:
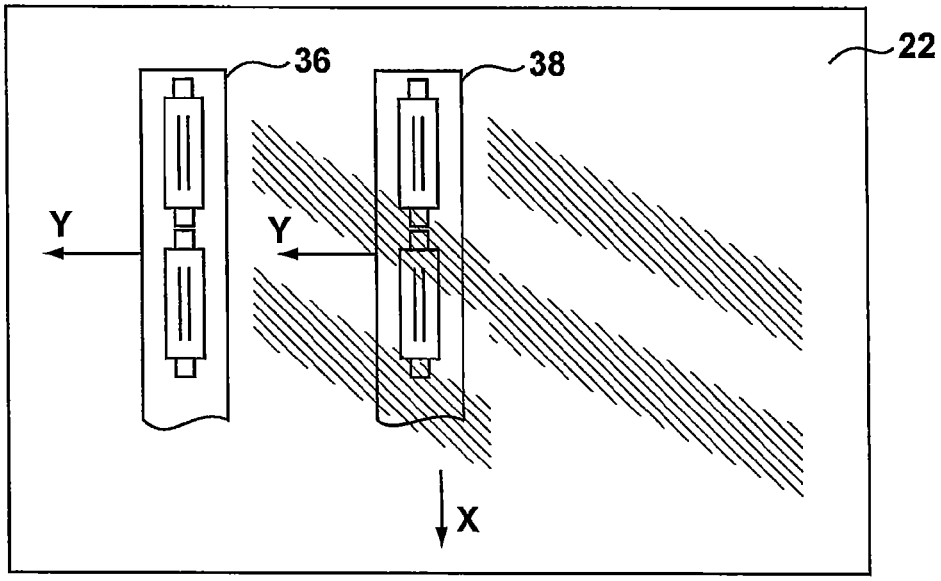
FIG. 12 shows part of a twin carriage embodiment of the invention.

In the above embodiments of FIGS. 6 to 11, the carriage pauses for maintenance after each traverse. It will however be understood that maintenance need only be performed after a full cycle or after several cycles. In the embodiment of FIG. 12, parts of two carriages 36, 38 are shown, arranged on a single beam (not shown). Each of the carriages 36, 38 may be according to any of the previous embodiments of FIGS. 6 to 11. Carriages 36, 38 are constrained to traverse together, each from one edge to the middle of the substrate 22. In this manner, the width of substrate experienced by each head is effectively halved. In general, depending upon the constraints of the system, this will allow the speed of transport to be doubled. Alternatively other advantages may be enjoyed including lower traverse speed, higher definition, reduced head complexity etc.

Figure 13:
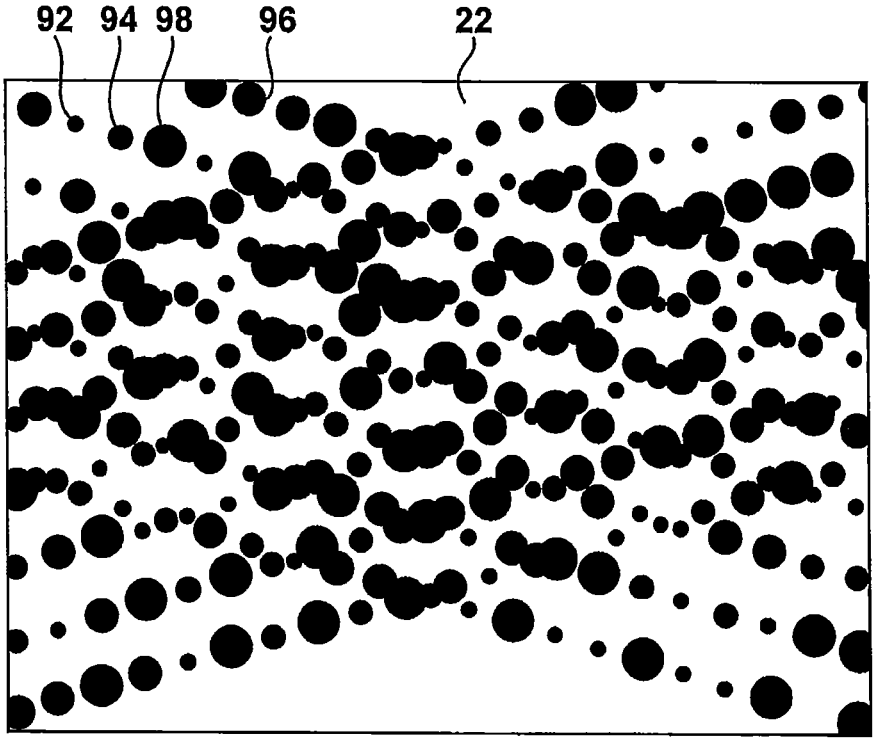
FIG. 13 shows a portion of substrate on which droplet deposition according to the invention has occurred.

FIG. 13 shows a portion of textile substrate 22 at greater magnification whereby the individual droplets can be seen. As can be seen, the droplets are deposited in diagonal lines 90 and are present in four different sizes 92, 94, 96 and 98 respectively. In the present case, these represent drop volumes of 16 pL, 24 pL, 32 pL and 40 pL. The droplet size at any particular pixel location has been determined randomly. This is believed to improve the uniformity of the final deposition.

The skilled person will be well aware of the many kinematic equivalents that exist for the above disclosed arrangements. By e.g. using a robot arm instead of a fixed beam, freedom of movement of the carriage in the transport direction may also be achieved. Such movement with two degrees of freedom may allow other possibilities of synchronisation between the carriage and the substrate while still requiring the same means of aligning the first and second sets or pluralities of heads with one another.

Thus, the invention has been described by reference to certain embodiments discussed above. It will be recognized that these embodiments are susceptible to various modifications and alternative forms without departing from the spirit and scope of the invention. Accordingly, although specific embodiments have been described, these are examples only and are not limiting upon the scope of the invention.

What is claimed is:

1. A print carriage for printing in diagonal mode onto a continuously moving substrate, the print carriage comprising:

a first plurality of inkjet heads arranged to deposit a substance onto the substrate in forward and reverse passes of a first diagonal swathe; and a second plurality of inkjet heads arranged to deposit the same substance onto the substrate in forward and reverse passes of a second diagonal swathe;

wherein the first and second pluralities of inkjet heads are arranged such that the first and second swathes complement one another on both forward and reverse passes and uniform coverage is achieved by superposition of the first and second swathes such that each portion of the substrate is covered either twice by one of the swathes or once by each swathe.

2. The print carriage according to claim 1, wherein the first and second plurality of inkjet heads are each arranged in comb formation.

3. The print carriage according to claim 1, wherein the first and second plurality of inkjet heads are mutually aligned and each head has a head length l, a spacing between the first and second plurality of inkjet heads corresponding to an even number (n=0, 2, 4 . . . ) of head lengths.

4. The print carriage according to claim 1, wherein the first and second plurality of inkjet heads are laterally offset from one another and an alignment arrangement is provided comprising an angling device adapted to rotate the first and second plurality of inkjet heads for respective forward and reverse passes.

5. The print carriage according to claim 1, wherein the first and second plurality of inkjet heads are laterally offset from one another and an alignment arrangement is provided comprising an adjustment device adapted to move the first plurality of inkjet heads with respect to the second plurality of inkjet heads for forward and reverse passes.

6. A printer, comprising:

a substrate transport device for continuously transporting a supply of substrate in a transport direction; and a print carriage according to claim 1 arranged to traverse across the substrate for deposition of the substance in first and second complementary diagonal swathes.

7. The printer according to claim 6, comprising a beam upon which the print carriage is mounted for traversing the substrate.

8. The printer according to claim 6, further comprising a control arrangement for synchronising a traverse speed or position of the print carriage to a transport speed or position of the substrate to ensure substantially complete coverage of the substrate.

9. The printer according to claim 6, wherein the substrate comprises a textile and the transport device comprises an attachment arrangement to prevent shifting of the substrate during deposition.

10. A method of depositing a substance onto a continuously moving substrate in first and second diagonal swathes, the method comprising:

providing a print carriage according to claim 1 comprising a first plurality of inkjet heads and a second plurality of inkjet heads;

traversing the print carriage across the substrate in a forward pass, while depositing the first and second diagonal swathes from the respective first and second plurality of inkjet heads;

subsequently traversing the print carriage across the substrate in a reverse pass;

aligning the first and second plurality of inkjet heads such that the first and second diagonal swathes complement one another on both forward and reverse passes; and repeating the forward and reverse passes to provide substantially complete coverage of the substrate.

11. The method according to claim 10, wherein the first and second plurality of inkjet heads are fixed with respect to one another and alignment of the first plurality of heads automatically leads to alignment of the second plurality of heads.

12. The method according to claim 10, wherein the first and second plurality of inkjet heads are aligned by rotation between a first angular orientation for the forward pass and a second angular orientation for the reverse pass.

13. The method according to claim 10, wherein the first and second plurality of inkjet heads are aligned by adjustment between a first relative position for the forward pass and a second relative position for the reverse pass.

14. The method according to claim 10, further comprising synchronising a traverse speed or position of the print carriage to a transport speed or position of the substrate to ensure alignment of a forward pass of the first swathe with a subsequent forward pass.

15. The method according to claim 10, further comprising controlling edge regions of respective swathes using stitching software to reduce alignment perturbations between passes.

16. The method according to claim 10, wherein the inkjet heads are of the grey-scale drop-on-demand type and the method further comprises adjusting the volume of substance deposited by each drop.

17. The method according to claim 10, comprising driving the inkjet heads using a dither function to provide accurate colour or shade reproduction.

18. The method according to claim 10, wherein the first plurality of inkjet heads is stacked in the traverse direction and the method comprises printing at a resolution in the traverse direction that is reduced for each head according to the degree of stacking.

19. The method according to claim 10, wherein the substrate is a textile and the substance is a finishing composition for application to the textile, selected from the group consisting of anti-static, anti-microbial, anti-viral, anti-fungal, medicinal, non-crease, flame-retardant, water-repellent, UV-protective, anti-odour, wear-resistant, stain-resistant, self-cleaning, adhesive, stiffening, softening, elasticity-enhancing, pigment-binding, conducting, semi-conducting, photo-sensitive, photo-voltaic, light-emitting, optical brightening, shrink resistant, handle imparting, filling & stiffening, weighting, softening, oil-repellent, soil repellent, soil release, felting, anti-felting, conditioning, lustring, delustring, non-slip, moisture vapour transport, anti-snagging, anti-microbiotic, reflecting, controlled release, indicating, phase changing, hydrophilic, hydrophobic, sensory, abrasion resistant and wetting agents.

20. A continuous substrate having deposited thereon a substance, the substance being deposited by a printer carriage according to claim 1 as individual droplets arranged in first and second complementary diagonal swathes, wherein the droplets are of varying sizes and/or are deposited at non-regular positions on the substrate, the first and second swathes being superposed to achieve substantially uniform coverage of the substrate whereby each portion of the substrate is covered either twice by one of the swathes or once by each swathe.

* * * * *